US011319496B2

(12) United States Patent
Fathi et al.

(10) Patent No.: US 11,319,496 B2
(45) Date of Patent: May 3, 2022

(54) SYSTEMS AND PROCESSES FOR HYDROCARBON BLENDING

(71) Applicant: Saudi Arabian Oil Company, Dhahran (SA)

(72) Inventors: Mazin M. Fathi, Dammam (SA); Ki-Hyouk Choi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 126 days.

(21) Appl. No.: 16/919,241

(22) Filed: Jul. 2, 2020

(65) Prior Publication Data

US 2022/0002624 A1 Jan. 6, 2022

(51) Int. Cl.
*C10G 31/08* (2006.01)
*B01F 3/08* (2006.01)
(Continued)

(52) U.S. Cl.
CPC ..... *C10G 31/08* (2013.01); *B01F 3/0092* (2013.01); *B01F 3/0803* (2013.01); *B01F 3/088* (2013.01);
(Continued)

(58) Field of Classification Search
CPC ..... C10G 31/08; C10G 2300/206; C10G 2300/4006; C10G 2300/4012;
(Continued)

(56) References Cited

U.S. PATENT DOCUMENTS 4,853,337 A 8/1989 Dickakian
8,864,978 B2 10/2014 Choi
(Continued)

FOREIGN PATENT DOCUMENTS

CN 101597511 A 12/2009
WO 2017106090 A1 6/2017
WO 2018165394 A1 9/2018

OTHER PUBLICATIONS

International Search Report and Written Opinion dated Mar. 19, 2021 pertaining to International application No. PCT/US2020/059802 filed Nov. 10, 2020, 12 pgs.
(Continued)

*Primary Examiner* — Youngsul Jeong
*Assistant Examiner* — Jason Y Chong
(74) *Attorney, Agent, or Firm* — Dinsmore & Shohl

(57) ABSTRACT

A process for blending a hydrocarbon-based composition that includes combining a first heated water stream with a first hydrocarbon-based composition comprising asphaltene to create a first combined feed stream and allowing the first heated water stream and the first hydrocarbon-based composition to interact such that the second combined feed stream comprises micelles and reverse micelles, thereby preventing asphaltene aggregation. The process further includes similarly combining a second heated water stream with a second hydrocarbon-based composition to form a second combined feed stream. The process further includes introducing the first combined feed stream and the second combined stream into a supercritical blending vessel operating at a temperature greater than a critical temperature of water and a pressure greater than a critical pressure of water, and blending the first combined feed stream and the second combined stream to form a blended hydrocarbon-based composition.

20 Claims, 2 Drawing Sheets

(51) Int. Cl.

| | |
|---|---|
| ***B01F 3/00*** | (2006.01) |
| ***B01F 3/10*** | (2006.01) |
| ***C10L 1/04*** | (2006.01) |

(52) U.S. Cl.

CPC *B01F 3/10* (2013.01); *C10L 1/04* (2013.01); *B01F 2003/0064* (2013.01); *B01F 2003/105* (2013.01); *B01F 2215/0088* (2013.01); *C10G 2300/206* (2013.01); *C10G 2300/4006* (2013.01); *C10G 2300/4012* (2013.01); *C10G 2300/807* (2013.01)

(58) Field of Classification Search

CPC .. C10G 2300/807; B01F 3/0803; B01F 3/088; B01F 3/0092; B01F 3/10; B01F 2003/0064; B01F 2003/105; B01F 2215/0088; C10L 1/04

See application file for complete search history.

(56) References Cited

U.S. PATENT DOCUMENTS

| | | | |
|---|---|---|---|
| 9,505,678 | B2 | 11/2016 | Choi et al. |
| 9,771,527 | B2 | 9/2017 | Choi et al. |
| 10,384,179 | B2 | 8/2019 | Choi et al. |
| 2004/0121472 | A1 | 6/2004 | Nemana et al. |
| 2012/0118794 | A1 | 5/2012 | Ho et al. |
| 2016/0312129 | A1* | 10/2016 | Choi ..... B01J 3/008 |
| 2018/0187096 | A1 | 7/2018 | Choi et al. |
| 2019/0218464 | A1 | 7/2019 | Choi et al. |

OTHER PUBLICATIONS

Brill et al. "Kinetics and mechanisms of hydrothermal organic reactions" Aqueous Systems at Elevated Temperatures and Pressures: Physical Chemistry in Water, Steam and Hydrothermal Solutions, Chapter 16 (2004), 33 pgs.

Ederer et al. "Modelling of the pyrolysis of tert-butylbenzene in supercritical water" Journal of Supercritical Fluids 15 (1995) 191-204, 14 pgs.

Floriano et al. "Dielectric Constant and Density of Water as a Function of Pressure at Constant Temperature" Brazilian Journal of Physics, vol. 34, No. 1, Mar. 2004, 4 pgs.

Iwamura et al. "Organic Reactions in Sub- and Supercritical Water in the Absence of Any Added Catalyst" J. Res. Inst. Sci. Tech., Nihon Univ. No. 132 pp. 1-9, 9 pgs.

Mullins et al. "Molecular Structure and Aggregation of Asphaltenes and Peteroleomics" SPE 95801 (2000), 10 pgs.

Rastegari et al. "Kinetics of Asphaltene Flocculation" Ind. Eng. Chem. Res. 2004, 43, 6861-6870, 10 pgs.

* cited by examiner

SYSTEMS AND PROCESSES FOR HYDROCARBON BLENDING

TECHNICAL FIELD

Embodiments of the present disclosure generally relate to upgrading petroleum-based compositions, and more specifically relate to supercritical reactor systems, methods, and uses for blending petroleum-based compositions.

BACKGROUND

Petroleum is an indispensable source of energy; however, most petroleum is heavy or sour petroleum, meaning that it contains a high amount of impurities (including sulfur and coke, a high-carbon petroleum residue). Heavy petroleum must be upgraded before it is a commercially valuable product, such as fuel. Greater volumes of new crude oils are becoming extractable in new areas around the world with vast diversity in properties, due to continuous improvement in oil and gas extraction. These new oils provide greater economic opportunities for the refiners around the globe through blending different types of crude oils, which is becoming increasingly more common (creating synthetic crude oils). However, the variability in crude oil properties represents substantial technical and logistical challenges. Feedstock variability forces refiners to continually adapt their process systems to accommodate different crude qualities. Furthermore, many conventionally produced crude oils are deviating significantly from their historical assay properties, and contaminant levels and varieties are becoming more complex.

SUMMARY

Blending new crude oils might result in incompatibility issues that include deterioration of oil stability due to a change in the oil composition of the system. This change may be caused by an increase in the paraffin fraction that in turn disrupts the state of asphaltenes suspension by stripping the resins from the peptizing colloid allowing aggregation of asphaltenes molecules that are prone to deposition under their heavy weight and large size.

Accordingly, a need exists for a hydrocarbon blending process that can blend incompatible oils without allowing asphaltene molecule aggregation or disrupting asphaltene suspension. Conventional processes that blend different oils in a refinery, tank farm, or oil producing facility. The blended oils may include mixtures of crude oils, residual oils, slop oils, by product oils, and/or blends thereof. However, due to blending compatibility limitations, conventional processes are unable to blend incompatible oils. Upon blending incompatible oils, wax and asphaltenes tend to separate and precipitate. This results in loss of valuable oil liquid yield, equipment and pipe line plugging and loss of product required specifications. For example, blending paraffinic oil with bituminous oil separates the asphaltenes in the bitumen oil and induces asphaltene precipitation. Although blending low value oil (such as bitumen) with high value conventional oil (such as Arab Light) increases oil volume of resultant blend and generate revenue, but this is not possible due to blending incompatibility. The present disclosure provides solutions by subsiding the blending incompatibility. This is achieved by utilizing supercritical water to localize, cage, and convert the otherwise associating troublesome particles in the oil upon blending. The present disclosure addresses this need by incorporating both heated subcritical water and supercritical water into the blending process. Additionally, the present disclosure exploits unique properties of water, such as the polarity of subcritical water and non-polarity of supercritical water. The present process blends incompatible oils by improving stability through localizing, disproportionating, and dispersing asphaltene in the oil medium. Combining the hydrocarbons with heated water at subcritical conditions improves oil stability by encapsulating the asphaltene aggregates through selective polar-polar interactions between water and asphaltene molecules. Then, blending the hydrocarbons in the presence of water at supercritical temperatures reduces asphaltene by breaking the large aggregates (having a particle size of 1 to 800 microns) into much smaller molecules (having a particle size of 0.1 to 300 nanometers).

In accordance with one embodiment of the present disclosure, a process for blending a hydrocarbon-based composition includes combining a first heated water stream with a first pressurized, heated hydrocarbon-based composition comprising asphaltene in a mixing device to create a first combined feed stream; allowing the first heated water stream and the first pressurized, heated hydrocarbon-based composition to interact such that the second combined feed stream comprises micelles and reverse micelles, thereby preventing asphaltene aggregation; combining a second heated water stream with a second pressurized, heated hydrocarbon-based composition comprising asphaltene in a mixing device to create a second combined feed stream; allowing the second heated water stream and the second pressurized, heated hydrocarbon-based composition to interact such that the second combined feed stream comprises micelles and reverse micelles, thereby preventing asphaltene aggregation; introducing the first combined feed stream and the second combined stream into a supercritical blending vessel operating at a temperature greater than a critical temperature of water and a pressure greater than a critical pressure of water; and blending the first combined feed stream and the second combined stream to form a blended hydrocarbon-based composition.

In another embodiment of the present disclosure, another process for blending a hydrocarbon-based composition is provided. The process includes combining a first heated water stream with a first pressurized, heated hydrocarbon-based composition comprising asphaltene in a mixing device to create a first combined feed stream; allowing the first heated water stream and the first pressurized, heated hydrocarbon-based composition to interact such that the first combined feed stream comprises micelles and reverse micelles, thereby preventing asphaltene aggregation; introducing the first combined feed stream into a first supercritical upgrading reactor operating at a temperature greater than a critical temperature of water and a pressure greater than a critical pressure of water; at least partially converting the first combined feed stream to a first upgraded product; combining a second heated water stream with a second pressurized, heated hydrocarbon-based composition comprising asphaltene in a mixing device to create a second combined feed stream; allowing the second heated water stream and the second pressurized, heated hydrocarbon-based composition to interact such that the second combined feed stream comprises micelles and reverse micelles, thereby preventing asphaltene aggregation; introducing the second combined feed stream into a second supercritical upgrading reactor operating at a temperature greater than a critical temperature of water and a pressure greater than a critical pressure of water; at least partially converting the second combined feed stream to a second upgraded product;

passing the first upgraded product out of the first supercritical upgrading reactor to a supercritical blending vessel operating at a temperature greater than a critical temperature of water and a pressure greater than a critical pressure of water; passing the second upgraded product out of the second supercritical upgrading reactor to the supercritical blending vessel operating at a temperature greater than a critical temperature of water and a pressure greater than a critical pressure of water; and blending the first upgraded product and the second upgraded product to form an upgraded blended hydrocarbon-based composition.

BRIEF DESCRIPTION OF THE DRAWINGS

The following detailed description of specific embodiments of the present disclosure can be best understood when read in conjunction with the following drawings, in which.

DETAILED DESCRIPTION

Figure 1:
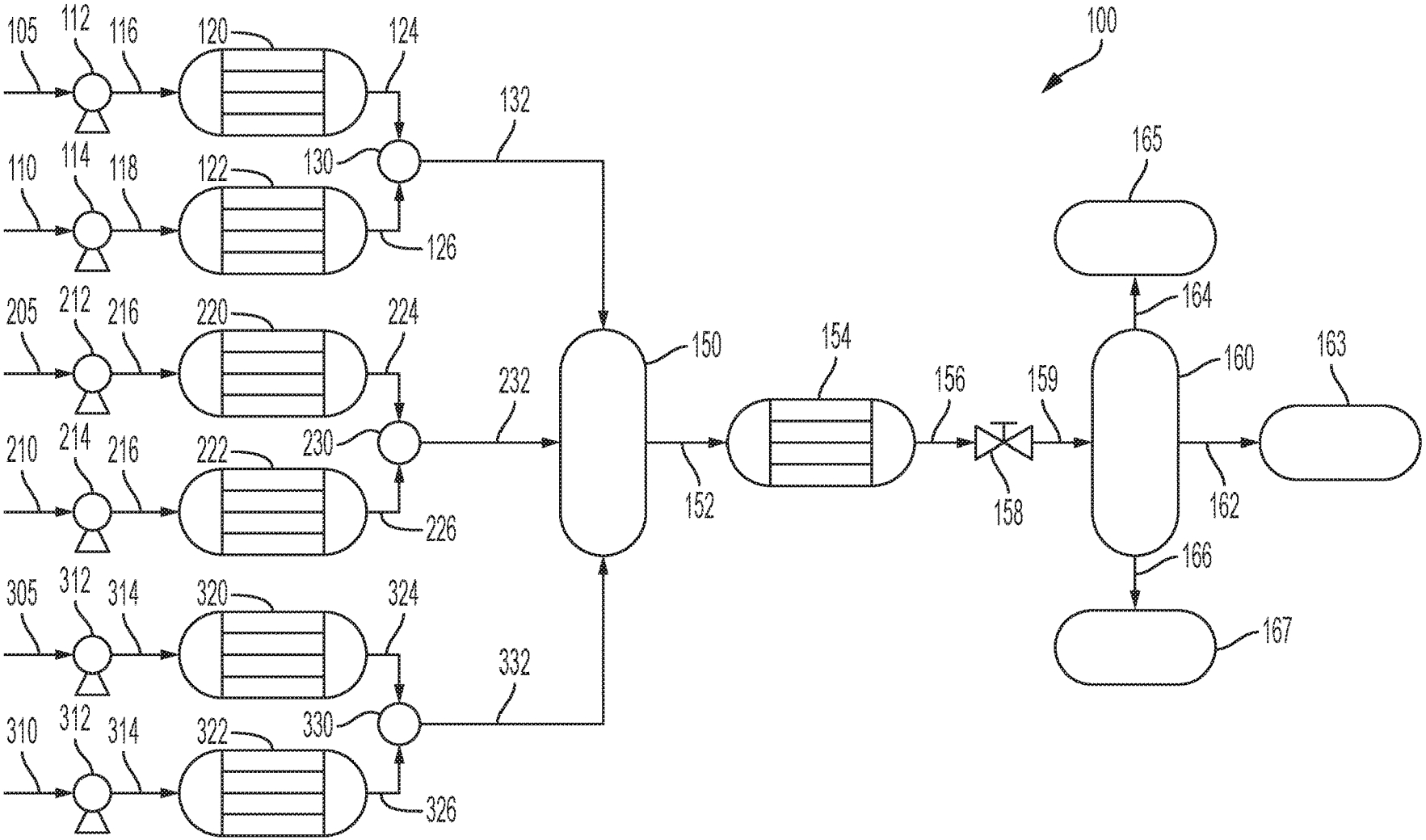
FIG. 1 is a schematic view of a process for blending a hydrocarbon-based composition, according to the present embodiments.

Embodiments of the present disclosure are directed to processes for blending hydrocarbon streams in a subcritical and supercritical water process.

As used throughout the disclosure, "blend" means to mix hydrocarbons to form a hydrocarbon mixture with specific physical properties, such as a desired viscosity or American Petroleum Institute (API) gravity.

As used throughout the disclosure, "supercritical" refers to a substance at or above a pressure and a temperature greater than or equal to that of its critical pressure and temperature, such that distinct phases do not exist and the substance may exhibit the fast diffusion of a gas while dissolving materials like a liquid. As such, supercritical water is water having a temperature and pressure greater than or equal to the critical temperature and the critical pressure of water. At a temperature and pressure greater than or equal to the critical temperature and pressure, the liquid and gas phase boundary of water disappears, and the fluid has characteristics of both liquid and gaseous substances. Supercritical water is able to dissolve organic compounds like an organic solvent and has excellent diffusibility like a gas. Regulation of the temperature and pressure allows for continuous "tuning" of the properties of the supercritical water to be more liquid-like or more gas-like. Supercritical water has reduced density and lesser polarity, as compared to liquid-phase subcritical water, thereby greatly extending the possible range of chemistry that can be carried out in water. Water above its critical condition is neither a liquid nor gas but a single fluid phase that converts from being polar to non-polar.

As used throughout the disclosure, "upgrade" means to increase the API gravity, decrease the amount of impurities, such as sulfur, nitrogen, and metals, decrease the amount of asphaltene, and increase the amount of the light fraction.

Supercritical water has various unexpected properties as it reaches supercritical boundaries. Supercritical water has very high solubility toward organic compounds and has an infinite miscibility with gases. Furthermore, radical species can be stabilized by supercritical water through the cage effect (that is, a condition whereby one or more water molecules surrounds the radical species, which then prevents the radical species from interacting). Without being limited to theory, stabilization of radical species helps prevent inter-radical condensation and thereby reduces the overall coke production in the current embodiments. For example, coke production can be the result of the inter-radical condensation. In certain embodiments, supercritical water generates hydrogen gas through a steam reforming reaction and water-gas shift reaction, which is then available for the upgrading reactions.

Moreover, the high temperature and high pressure of supercritical water may give supercritical water a density of 0.123 grams per milliliter (g/mL) at 27 MPa and 450° C. Contrastingly, if the pressure was reduced to produce superheated steam, for example, at 20 MPa and 450° C., the superheated steam would have a density of only 0.079 g/mL. At that density, the hydrocarbons may interact with the superheated steam to evaporate and mix into the vapor phase, leaving behind a heavy fraction that may generate coke upon heating. The formation of coke or coke precursor may plug the lines and must be removed. Therefore, supercritical water is superior to steam in some applications.

Specific embodiments will now be described with references to the figures. Whenever possible, the same reference numerals will be used throughout the drawings to refer to the same or like parts.

Figure 2:
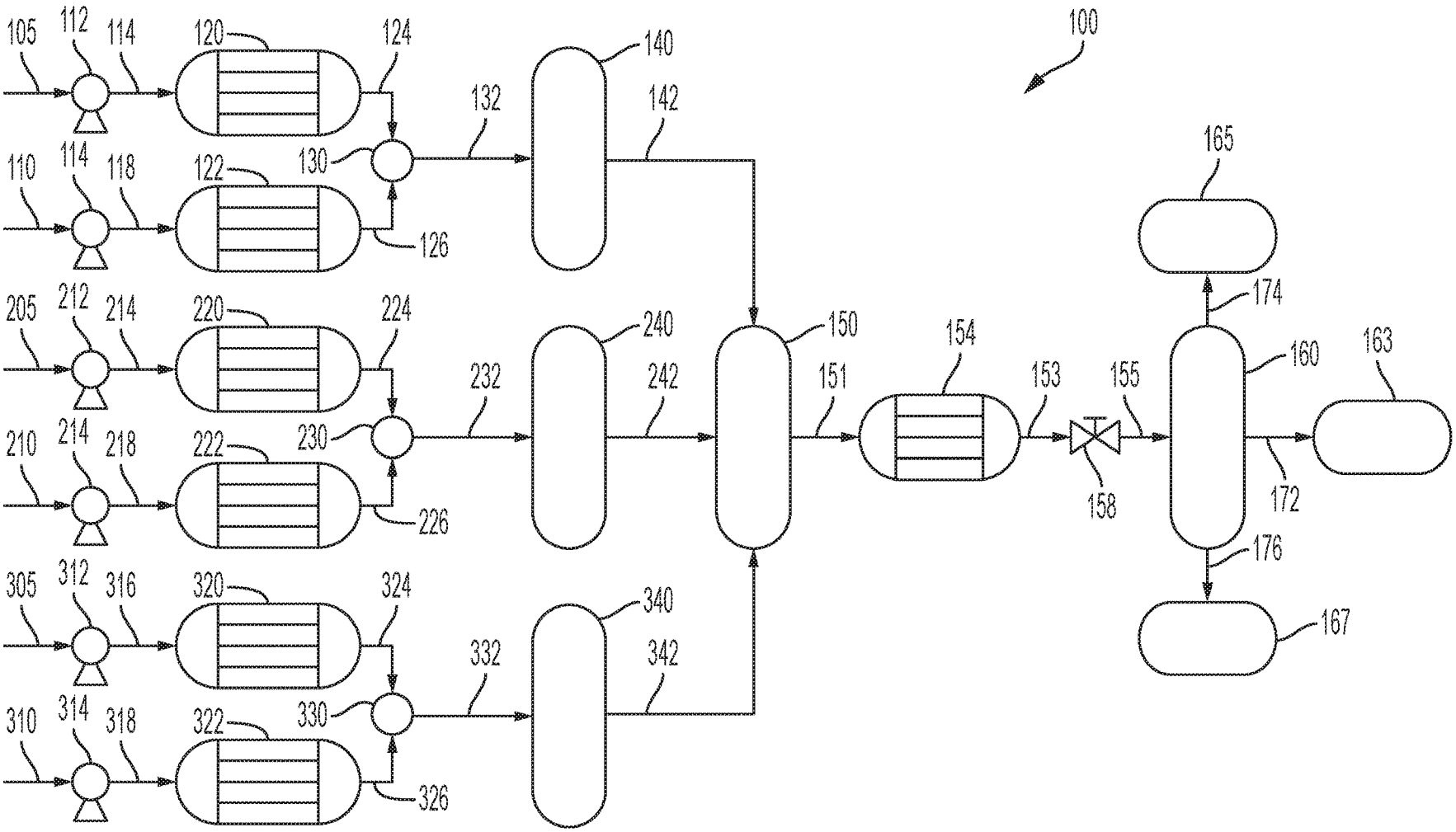
FIG. 2 is a schematic view of a process for blending a hydrocarbon-based composition, according to the present embodiments.

FIGS. 1 and 2 schematically depict various processes 100 for blending a first hydrocarbon-based composition 105, a second hydrocarbon-based composition 205, and a third hydrocarbon-based composition 305, according to embodiments described. FIGS. 1 and 2 are not intended to be limiting to this disclosure, and the process disclosed herein may include only the first and second hydrocarbon-based compositions 105 and 205 in some embodiments, or may include additional hydrocarbon-based compositions not shown in FIGS. 1 and 2, such as a fourth, fifth, sixth, or seventh hydrocarbon-based composition.

In embodiments, the hydrocarbon-based compositions 105, 205, and 305 may be different in terms of oil type, viscosity, TBP distillation, API gravity, and composition. For example, and not by way of limitation, the first hydrocarbon-based composition 105 may have an API gravity of from 12° to 50°, from 12° to 40°, from 12° to 35°, from 12° to 33°, from 15° to 50°, from 15° to 40°, from 15° to 35°, from 15° to 33°, from 20° to 50°, from 20° to 40°, from 20° to 35°, from 20° to 33°, from 25° to 50°, from 25° to 40°, from 25° to 35°, from 25° to 33°, from 30° to 50°, from 30° to 40°, from 30° to 35°, from 30° to 33°, from 31° to 50°, from 31° to 40°, from 31° to 35°, from 31° to 33°, or approximately 32°; a paraffin content of from 19 to 67 wt. %, from 19 to 65 wt. %, from 19 to 60 wt. %, from 19 to 56 wt. %, from 25 to 67 wt. %, from 25 to 65 wt. %, from 25 to 60 wt. %, from 25 to 56 wt. %, from 35 to 67 wt. %, from 35 to 65 wt. %, from 35 to 60 wt. %, from 35 to 56 wt. %, from 45 to 67 wt. %, from 45 to 65 wt. %, from 45 to 60 wt. %, from 45 to 56 wt. %, from 50 to 67 wt. %, from 50 to 65 wt. %, from 50 to 60 wt. %, from 50 to 56 wt. %, from 54 to 67 wt. %, from 54 to 65 wt. %, from 54 to 60 wt. %, from 54 to 56 wt. %, or approximately 55 wt. %; and an asphaltene content of from 1 to 14 wt. %, from 1 to 10 wt. %, from 1 to 8 wt. %, from 1 to 7 wt. %, from 3 to 14 wt. %, from 3 to 10 wt. %, from 3 to 8 wt. %, from 3 to 7 wt. %, from 5 to 14 wt. %, from 5 to 10 wt. %, from 5 to 8 wt. %, from 5 to 7 wt. %, or approximately 6 wt. %.

In embodiments, the second hydrocarbon-based composition 205 may have an API gravity of from 1° to 31°, from 1° to 20°, from 1° to 15°, from 1° to 12°, from 1° to 10°, from 1 to 9°, from 5° to 31°, from 5° to 20°, from 5° to 15°, from 5° to 12°, from 5° to 10°, from 5 to 9°, from 7° to 31°, from 7° to 20°, from 7° to 15°, from 7° to 12°, from 7° to 10°, from 7 to 9°, or approximately 8°; a paraffin content of from 1 to 54 wt. %, from 1 to 30 wt. %, from 1 to 20 wt. %, from 1 to 17 wt. %, from 1 to 16 wt. %, from 5 to 54 wt. %, from 5 to 30 wt. %, from 5 to 20 wt. %, from 5 to 17 wt. %, from 5 to 16 wt. %, from 10 to 54 wt. %, from 10 to 30 wt. %, from 10 to 20 wt. %, from 10 to 17 wt. %, from 10 to 16 wt. %, from 12 to 54 wt. %, from 12 to 30 wt. %, from 12 to 20 wt. %, from 12 to 17 wt. %, from 12 to 16 wt. %, from 14 to 54 wt. %, from 14 to 30 wt. %, from 14 to 20 wt. %, from 14 to 17 wt. %, from 14 to 16 wt. %, or approximately 15 wt. %; and an asphaltene content of from 7 to 30 wt. %, from 7 to 25 wt. %, from 7 to 22 wt. %, from 7 to 19 wt. %, from 13 to 30 wt. %, from 13 to 25 wt. %, from 13 to 22 wt. %, from 13 to 19 wt. %, from 16 to 30 wt. %, from 16 to 25 wt. %, from 16 to 22 wt. %, from 16 to 19 wt. %, or approximately 18 wt. %.

The third hydrocarbon-based composition 305 may have an API gravity of from 1° to 31°, from 1° to 25°, from 1° to 20°, from 1° to 15°, from 1° to 12°, from 5° to 31°, from 5° to 25°, from 5° to 20°, from 5° to 15°, from 5° to 12°, from 9° to 31°, from 9° to 25°, from 9° to 20°, from 9° to 15°, from 9° to 12°, or approximately 11°; a paraffin content of from 5 to 54 wt. %, from 5 to 30 wt. %, from 5 to 25 wt. %, from 5 to 20 wt. %, from 10 to 54 wt. %, from 10 to 30 wt. %, from 10 to 25 wt. %, from 10 to 20 wt. %, from 16 to 54 wt. %, from 16 to 30 wt. %, from 16 to 25 wt. %, from 16 to 20 wt. %, or approximately 18 wt. %; and an asphaltene content of from 7 to 30 wt. %, from 7 to 25 wt. %, from 7 to 20 wt. %, from 7 to 17 wt. %, from 10 to 30 wt. %, from 10 to 25 wt. %, from 10 to 20 wt. %, from 10 to 17 wt. %, from 13 to 30 wt. %, from 13 to 25 wt. %, from 13 to 20 wt. %, from 13 to 17 wt. %, or approximately 15 wt. %.

The conventional blending of these streams will deposit the asphaltenes of the second and third hydrocarbon-based compositions 205 and 305 by the effect of the paraffin content of the first hydrocarbon-based composition 105. However, if the blending takes place in the presence of supercritical water, as will be described in further detail within the disclosure, the larger asphaltene molecules will be dissolved in the supercritical water and the supercritical water will prevent the association, growth, and eventual precipitation of the asphaltene molecules. Furthermore, the metal content of the hydrocarbon streams is directly proportional to the asphaltenes content. Metals induce asphaltenes precipitation by promoting polar-polar interaction between asphaltenes aggregates. These metals in asphaltenes are transferred to the ScW upon asphaltenes dissolution or dissociation in the ScW. Therefore, ScW minimizes asphaltenes precipitation in oil by dissolution, caging, and removal of asphaltenes precipitation promoters. Each of the hydrocarbon-based compositions 105, 205, and 305 are heated in the hydrocarbon heaters 120, 220, and 320 to conditions that ease their mixing with saturated water. The heating conditions may be similar or different depending on the viscosity of the hydrocarbon-based compositions. For example, and not by way of limitation, bitumen oil is solid under standard temperature and pressure needs to be heated to at least 120° C. to reduce the viscosity enough to mix with water, whereas Arabian Light crude oil needs only to be heated to at least 60° C. to reduce the viscosity enough to mix with water. It is contemplated that mixing the hydrocarbon-based compositions with water prior to blending prevents asphaltene precipitation. Water at saturated conditions has high polarity and can interact with the polar asphaltenes moieties in the oils by micellar polar-polar interaction and cage the asphaltenes before they associate and precipitate by the effect of the high paraffinic fraction, for example, the paraffinic fraction present in the first hydrocarbon-based composition 105 as described above.

The hydrocarbon-based compositions 105, 205, and 305 may refer to any hydrocarbon source derived from petroleum, coal liquid, or biomaterials. Possible sources for hydrocarbon-based compositions may include crude oil, distilled crude oil, reduced crude oil, residue oil, topped crude oil, product streams from oil refineries, product streams from steam cracking processes, liquefied coals, liquid products recovered from oil or tar sands, bitumen, oil shale, asphaltene, biomass hydrocarbons, and the like. Many compositions are suitable for the hydrocarbon-based compositions. In some embodiments, the hydrocarbon-based compositions 105, 205, and 305 may comprise heavy crude oil or a fraction of heavy crude oil. In other embodiments, the hydrocarbon-based compositions 105, 205, and 305 may include atmospheric residue (AR), atmospheric distillates, vacuum gas oil (VGO), vacuum distillates, or vacuum residue (VR), or cracked product (such as light cycle oil or coker gas oil). In some embodiments, the hydrocarbon-based compositions 105, 205 and 305 may be combined streams from a refinery, produced oil, or other hydrocarbon streams, such as from an upstream operation. The hydrocarbon-based composition 105 may be decanted oil, oil containing 10 or more carbons (C10+ oil), or hydrocarbon streams from an ethylene plant. The hydrocarbon-based compositions 105, 205, and 305 may, in some embodiments, be liquefied coal or biomaterial-derivatives, such as bio fuel oil. In some embodiments, used lubrication (lube) oil or brake fluids may be used.

The hydrocarbon-based compositions 105, 205, and 305 may, in some embodiments, be naphtha or kerosene or diesel fractions. Such fractions may be used but may not be upgraded as efficiently by the supercritical water as other fractions. Contaminated hydrocarbon fractions may also be used. In some embodiments, fractions with saltwater contamination may be used as the hydrocarbon-based compositions 105, 205, and 305. For instance, crude oil in market typically has a salt content below about 10 PTB (pounds of salt per 1000 barrels of oil). The salt in saltwater may be precipitated by the supercritical water to produce a desalted product, which may be desirable in some embodiments.

As shown in FIGS. 1 and 2, the hydrocarbon-based compositions 105, 205, and 305 may be pressurized in first hydrocarbon pump 112, second hydrocarbon pump 212, and third hydrocarbon pump 312, respectively, to create first pressurized hydrocarbon-based composition 116, second pressurized hydrocarbon-based composition 216, and third pressurized hydrocarbon-based composition 316. The pressure of pressurized hydrocarbon-based compositions 116, 216, and 316 may be from 0.101 to 21.04 megapascals (MPa), from 0.101 to 20 MPa, from 0.101 to 15 MPa, from 0.101 to 10 MPa, from 0.101 to 5 MPa, from 0.101 to 1 MPa, from 1 to 21.04 MPa, from 1 to 20 MPa, from 1 to 15 MPa, from 1 to 10 MPa, from 1 to 5 MPa, from 5 to 21.04 MPa, from 5 to 20 MPa, from 5 to 15 MPa, from 5 to 10 MPa, from 10 to 21.04 MPa, from 10 to 20 MPa, from 10 to 15 MPa, from 15 to 21.04 MPa, from 15 to 20 MPa, or from 20 to 21.04 MPa.

Referring still to any of FIGS. 1 and 2, the pressurized hydrocarbon-based compositions 116, 216, and 316 may then be heated in one or more first hydrocarbon pre-heaters 120, second hydrocarbon pre-heaters 220, and third hydrocarbon pre-heaters 320 to form first pressurized, heated hydrocarbon-based composition 124, second pressurized, heated hydrocarbon-based composition 224, and third pressurized, heated hydrocarbon-based composition 324, respectively. In one embodiment, the pressurized, heated hydrocarbon-based compositions 124, 224, and 324 have a pressure from 0.101 to 21.04 megapascals (MPa), from 0.101 to 20 MPa, from 0.101 to 15 MPa, from 0.101 to 10 MPa, from 0.101 to 5 MPa, from 0.101 to 1 MPa, from 1 to 21.04 MPa, from 1 to 20 MPa, from 1 to 15 MPa, from 1 to 10 MPa, from 1 to 5 MPa, from 5 to 21.04 MPa, from 5 to 20 MPa, from 5 to 15 MPa, from 5 to 10 MPa, from 10 to 21.04 MPa, from 10 to 20 MPa, from 10 to 15 MPa, from 15 to 21.04 MPa, from 15 to 20 MPa, or from 20 to 21.04 MPa. and a temperature from 100° C. to 370° C., from 100° C. to 350° C., from 100° C. to 300° C., from 100° C. to 250° C., from 100° C. to 200° C., from 100° C. to 150° C., from 150° C. to 370° C., from 150° C. to 350° C., from 150° C. to 300° C., from 150° C. to 250° C., from 150° C. to 200° C., from 200° C. to 370° C., from 200° C. to 350° C., from 200° C. to 300° C., from 200° C. to 250° C., from 250° C. to 370° C., from 250° C. to 350° C., from 250° C. to 300° C., from 300° C. to 370° C., from 300 to 350° C., or from 350° C. to 370° C.

Embodiments of the hydrocarbon pre-heaters 120, 220, and 320 may include a natural gas fired heater, heat exchanger, or an electric heater or any type of heater known in the art. In some embodiments, not shown, the pressurized, heated hydrocarbon-based compositions 124, 224, and 324 may be heated in a double pipe heat exchanger. For example, and not by way of limitation, the double pipe heat exchanger may heat the pressurized, heated hydrocarbon-based compositions 124, 224, and 324 after it has combined with a first heated water stream 126, a second heated water stream 226, or a third heated water stream 326, respectively, to form a first combined feed stream 130, a second combined feed stream 230, or a third combined feed stream 330, respectively. In embodiments, the combined feed streams 130, 230, and 330 may be heated inside the supercritical blending vessel 150 to reach the conditions of supercritical water.

As shown in FIGS. 1 and 2, the water streams 110, 210, and 310 may be any source of water, such as a water stream having conductivity of less than 1 microSiemens (μS)/centimeters (cm), such as less than 0.1 μS/cm. The water streams 110, 210, and 310 may also include demineralized water, distilled water, boiler feed water (BFW), and deionized water. In at least one embodiment, the water streams 110, 210, and 310 is a boiler feed water stream. The water streams 110, 210, and 310 are pressurized by first water pump 114, second water pump 214, or third water pump 314, respectively, to produce first pressurized water stream 118, second pressurized water stream 218, or third pressurized water stream 318, respectively. The pressure of the pressurized water streams 118, 218, and 318 may be from 0.101 to 21.04 megapascals (MPa), from 0.101 to 20 MPa, from 0.101 to 15 MPa, from 0.101 to 10 MPa, from 0.101 to 5 MPa, from 0.101 to 1 MPa, from 1 to 21.04 MPa, from 1 to 20 MPa, from 1 to 15 MPa, from 1 to 10 MPa, from 1 to 5 MPa, from 5 to 21.04 MPa, from 5 to 20 MPa, from 5 to 15 MPa, from 5 to 10 MPa, from 10 to 21.04 MPa, from 10 to 20 MPa, from 10 to 15 MPa, from 15 to 21.04 MPa, from 15 to 20 MPa, or from 20 to 21.04 MPa.

The pressurized water streams 118, 218, and 318 may then be heated in a first water pre-heater 122, a second water pre-heater 222, or a third water preheater 322, respectively, to create heated water streams 126, 226, and 326. The temperature of the heated water streams 126, 226, and 326 is greater than 100° C. In embodiments, the temperature of the heated water streams 126, 226, and 326 may be from 100° C. to 370° C., from 100° C. to 350° C., from 100° C. to 300° C., from 100° C. to 250° C., from 100° C. to 200° C., from 100° C. to 150° C., from 150° C. to 370° C., from 150° C. to 350° C., from 150° C. to 300° C., from 150° C. to 250° C., from 150° C. to 200° C., from 200° C. to 370° C., from 200° C. to 350° C., from 200° C. to 300° C., from 200° C. to 250° C., from 250° C. to 370° C., from 250° C. to 350° C., from 250° C. to 300° C., from 300° C. to 370° C., from 300° C. to 350° C., or from 350° C. to 370° C.

Similar to hydrocarbon pre-heaters 120, 220, and 320, suitable water pre-heaters 122, 222, and 322 may include a natural gas fired heater, a heat exchanger, and an electric heater. In embodiments, the water pre-heaters 122, 222, and 322 may be a unit separate and independent from the hydrocarbon pre-heaters 120, 220, and 320. In embodiments, hydrocarbon pre-heater 120 and water pre-heater 122 may be a single unit. Similarly, hydrocarbon pre-heater 220 and water pre-heater 222 may be a single unit. Additionally or alternatively, hydrocarbon-preheater 320 and water-preheater 322 may be a single unit.

The first heated water stream 126 and the first pressurized, heated hydrocarbon-based composition 124 may then be mixed in a feed mixer 130 to produce a first combined feed stream 132. The second heated water stream 226 and the second pressurized, heated hydrocarbon-based composition 224 may then be mixed in a feed mixer 230 to produce a second combined feed stream 232. The third heated water stream 326 and the third pressurized, heated hydrocarbon-based composition 324 may then be mixed in a feed mixer 330 to produce a third combined feed stream 332. The feed mixers 130, 230, and 330 can be any type of mixing device capable of mixing the heated water streams 126, 226, and 326 and the pressurized, heated hydrocarbon-based compositions 124, 224, and 324. In embodiments, the feed mixers 130, 230, and 330 may be a mixing tee. In one or more embodiments, the feed mixers 130, 230, and 330 may be an ultrasonic device, a small continuous stir tank reactor (CSTR), or any suitable mixer. The volumetric flow ratio of water to hydrocarbons fed to the feed mixers 130, 230, and 330 may vary. In one embodiment, the volumetric flow ratio may be from 10:1 to 1:10, or 5:1 to 1:5, 1:1 to 4:1 at standard ambient temperature and pressure (SATP).

It is contemplated that allowing the respective heated water streams 126, 226, and 326 and the respective pressurized, heated hydrocarbon-based compositions 124, 224, and 324 to interact to form the combined feed streams 132, 232, and 332, respectively, improves the stability of the combined feed streams 132, 232, and 332 due to polar-polar interaction between water molecules and aggregated asphaltene molecules. Asphaltenes are amphiphilic molecules that can adsorb on the oil/water interface, at water saturation conditions, thereby acting as a surfactant through its hydrophilic (polar interaction) and lipophilic (non-polar interaction) abilities, which help in stabilizing liquid water in oil emulsions. In particular, interactions between the heated water, the non-polar hydrocarbons, and the asphaltenes present within the combined feed streams 132, 232, and 332 cause the asphaltene molecules to form micelles and reverse micelles with water molecules. This interaction enables the heated water to capture asphaltene molecules and cage them, thereby preventing asphaltene aggregation and association. The phenomena allows increasing hydrocarbon upgrading severity, which increases liquid yield and improves hydrocarbon stability at the expense of asphaltene deposition. High asphaltene content in the hydrocarbon-based composition reduces the stability and limits the upgradability of the hydrocarbon-based composition by increasing reaction temperature. This is because high reaction temperatures induce severe cracking, thereby increasing the amount of radical formation, and eventually leading to asphaltene aggregation reactions. Once asphaltene aggregation is subsided by the solvent and the supercritical water exhibits the cage effect, the oil upgrading severity window is increased (i.e. the upgrading temperature can be increased further without having the potential risk of asphaltenes aggregation and precipitation and coke formation). Furthermore, the supercritical water converts part of the asphaltene fraction into lighter hydrocarbons thereby reducing the availability of asphaltene for aggregation, which improves the oil stability.

At this point in the process, the embodiments depicted in FIGS. 1 and 2 begin to diverge, as FIG. 1 illustrates a process wherein the combined feed streams 132, 232, and 332 are sent directly to a supercritical blending vessel 150, and FIG. 2 illustrates a process wherein the combined feed streams 132, 232, and 332 are sent to a first supercritical upgrading reactor 140, a second supercritical upgrading reactor 240, and a third supercritical upgrading reactor 340, respectively, before being sent to the supercritical blending vessel 150.

Referring to FIG. 1, the combined feed streams 132, 232, and 332 are sent directly to the supercritical blending vessel 150. The supercritical blending vessel 150 may operate at a temperature greater than the critical temperature of water and a pressure greater than the critical pressure of water. In one or more embodiments, the supercritical blending vessel 150 may have a temperature of between 380° C. and 480° C., or between 390° C. and 450° C. The supercritical blending vessel 150 may blend the combined feed streams 132, 232, and 332 with a static mixer, an inline mixer, an impeller, an agitator, or any other suitable internal mixing device. Without intending to be bound by theory, it is beneficial to combine the combined feed streams 132, 232, and 332 in the supercritical blending vessel 150 because blending incompatibles oils upstream of the supercritical blending vessel 150, in the absence of supercritical water, may result in asphaltene aggregation and precipitation, as described in this disclosure. The supercritical blending vessel 150 may break, dissolve, and disperse the large asphaltene aggregates in the combined feed streams 132, 232, and 332 while being blended, thereby eliminating hydrocarbon blending incompatibility. Hydrocarbon blending in the supercritical blending vessel 150 is facilitated by the dissolution effect of the supercritical water within the combined feed streams 132, 232, and 332 that brings hydrocarbons having different densities and viscosities in close proximity to facilitate blending while breaking the large asphaltene aggregates present into smaller asphaltene molecules. Specifically, the micellar water molecules surrounding the asphaltenes molecules (as previously described) at supercritical conditions breaks the asphaltene molecules into smaller molecules and disperses them, thereby further improving the stability of the blended hydrocarbon-based composition.

In embodiments, the large asphaltene aggregates may have a particle size of from 1 to 800 microns, from 1 to 600 microns, from 1 to 400 microns, from 1 to 200 microns, from 1 to 100 microns, from 100 to 800 microns, from 100 to 600 microns, from 100 to 400 microns, from 100 to 200 microns, from 200 to 800 microns, from 200 to 600 microns, from 200 to 400 microns, from 400 to 800 microns, from 400 to 600 microns, or from 600 to 800 microns. In embodiments, the smaller asphaltene molecules may have a particle size of from 0.1 to 300 nanometers (nm), from 0.1 to 250 nm, from 0.1 to 200 nm, from 0.1 to 100 nm, from 0.1 to 100 nm, from 0.1 to 50 nm, from 0.1 to 20 nm, from 0.1 to 10 nm, from 0.1 to 5 nm, from 5 to 300 nm, from 5 to 250 nm, from 5 to 200 nm, from 5 to 100 nm, from 5 to 100 nm, from 5 to 50 nm, from 5 to 20 nm, from 5 to 10 nm, from 5 to 5 nm, from 10 to 300 nm from 10 to 250 nm, from 10 to 200 nm, from 10 to 150 nm, from 10 to 100 nm, from 10 to 50 nm, from 10 to 20 nm, from 20 to 300 nm from 20 to 250 nm, from 20 to 200 nm, from 20 to 150 nm, from 20 to 100 nm, from 20 to 50 nm, from 50 to 300 nm from 50 to 250 nm, from 50 to 200 nm, from 50 to 150 nm, from 50 to 100 nm, from 100 to 300 nm, from 100 to 250 nm, from 100 to 150 nm, from 150 to 300 nm, from 150 to 250 nm, from 150 to 200 nm, from 200 to 300 nm, or from 250 to 300 nm.

It is contemplated that the hydrocarbon blending in the presence of supercritical water simultaneously keeps the asphaltene well-dispersed within the hydrocarbons, thereby preventing large asphaltene aggregates from forming or reforming after breaking. The present process has the further benefit of upgrading the hydrocarbons present in the supercritical blending vessel 150 due to the presence of supercritical water.

Referring again to FIG. 1, upon exiting the supercritical blending vessel 150, the blended hydrocarbon-based composition 152 may have a temperature of from 380° C. to 450° C., from 380° C. to 425° C., from 380° C. to 400° C., from 400° C. to 450° C., from 400° C. to 425° C., or from 425° C. to 450° C. at the critical pressure of water. In embodiments, the blended hydrocarbon-based composition 152 may then be cooled by cooler 154 to a temperature of from 180° C. to 250° C., from 180° C. to 225° C., from 180° C. to 200° C., from 200° C. to 250° C., from 200° C. to 225° C., or from 225° C. to 250° C. at the critical pressure of water to form a cooled, blended hydrocarbon-based composition 156. Various cooling devices are contemplated for the cooler 154, such as a heat exchanger.

Upon exiting the cooler 154, the pressure of the cooled, blended hydrocarbon-based composition 156 may be reduced to create a depressurized, blended hydrocarbon-based composition 159, which may have a pressure from 0.01 to 1.0 MPa, from 0.01 to 0.8 MPa, from 0.01 to 0.5 MPa, from 0.01 to 0.3 MPa, from 0.01 to 0.1 MPa, from 0.01 to 0.08 MPa, from 0.01 to 0.05 MPa, from 0.01 to 0.03 MPa, from 0.03 to 1.0 MPa, from 0.03 to 0.8 MPa, from 0.03 to 0.5 MPa, from 0.03 to 0.3 MPa, from 0.03 to 0.1 MPa, from 0.03 to 0.08 MPa, from 0.03 to 0.05 MPa, from 0.05 to 1.0 MPa, from 0.05 to 0.8 MPa, from 0.05 to 0.5 MPa, from 0.05 to 0.3 MPa, from 0.05 to 0.1 MPa, from 0.05 to 0.08 MPa, from 0.08 to 1.0 MPa, from 0.08 to 0.8 MPa, from 0.08 to 0.5 MPa, from 0.08 to 0.3 MPa, from 0.08 to 0.1 MPa, from 0.1 to 1.0 MPa, from 0.1 to 0.8 MPa, from 0.1 to 0.5 MPa, from 0.1 to 0.3 MPa, from 0.3 to 1.0 MPa, from 0.3 to 0.8 MPa, from 0.3 to 0.5 MPa, from 0.5 to 1.0 MPa, from 0.5 to 0.8 MPa, or from 0.8 to 1.0 MPa. The depressurizing can be achieved by many devices, for example, a valve 158 as shown in FIGS. 1 and 2.

The depressurized, blended hydrocarbon-based composition 159 may then be passed to a gas/oil/water separator 160. The gas/oil/water separator 160 may separate the depressurized, blended hydrocarbon-based composition 159 into a first gas fraction 164, a first liquid oil fraction 162 and a first water fraction 166. The gas/oil/water separator 160 may be any separator known in the industry. While the gas/oil/water separator 160 may separate the depressurized, blended hydrocarbon-based composition 159 into at least a first gas fraction 164, a first liquid oil fraction 162, and a first water fraction 166, it should be appreciated that additional fractions may also be produced. The first gas fraction 164 may include CO, $CO_2$, $H_2S$, $C_1$, $C_2$, $C_3$, $C_4$, or combinations thereof. The first liquid oil fraction 162 may have a $T_5$ TBP of from 100° C. to 350° C., from 100° C. to 325° C., from 100° C. to 300° C., from 100° C. to 250° C., from 100° C. to 200° C., from 200° C. to 350° C., from 200° C. to 325° C., from 200° C. to 300° C., from 200° C. to 250° C., from 250° C. to 350° C., from 250° C. to 325° C., from 250° C. to 300° C., from 300° C. to 350° C., from 300° C. to 325° C., or from 325° C. to 350° C. The first liquid oil fraction 162 may have a $T_{90}$ TBP of from 200° C. to 450° C., from 200° C. to 425° C., from 200° C. to 400° C., from 200° C. to 375° C., from 200° C. to 350° C., from 200° C. to 300° C., from 300° C. to 450° C., from 300° C. to 425° C., from 300° C. to 400° C., from 300° C. to 375° C., from 300° C. to 350° C., from 350° C. to 450° C., from 350° C. to 425° C., from 350° C. to 400° C., from 350° C. to 375° C., from 375° C. to 450° C., from 375° C. to 425° C., from 375° C. to 400° C., from 400° C. to 450° C., from 400° C. to 425° C., or from 425° C. to 450° C. In embodiments, the first liquid oil fraction 162 may have an API gravity of from 35° to 50°, from 35° to 45°, from 35° to 42°, from 35° to 40°, from 35° to 37°, from 37° to 50°, from 37° to 45°, from 37° to 42°, from 37° to 40°, from 40° to 50°, from 40° to 45°, from 40° to 42°, from 42° to 50°, from 42° to 45°, or from 45° to 50°. As shown in FIG. 1, the first gas fraction 164 may be passed to a gas storage tank 165, the first liquid oil fraction 162 may be passed to an oil storage tank 163, and the first water fraction 166 may be passed to a water storage tank 167.

In embodiments, as shown in FIG. 2, the combined feed streams 132, 232, and 332 may be introduced to supercritical upgrading reactors 140, 240, and 340, as previously described. The supercritical upgrading reactors 140, 240, and 340 are configured to upgrade the combined feed streams 132, 232, and 332, respectively. The supercritical upgrading reactors 140, 240, and 340 may be an upflow, downflow, or horizontal flow reactor. An upflow, downflow or horizontal reactor refers to the direction the supercritical water and hydrocarbon-based composition flow through the supercritical upgrading reactors 140, 240, and 340. An upflow, downflow, or horizontal flow reactor may be chosen based on the desired application and system configuration. Without intending to be bound by any theory, in downflow supercritical reactors, heavy hydrocarbon fractions may flow very quickly due to having a greater density, which may result in shortened residence times (known as channeling). This may hinder upgrading, as there is less time for reactions to occur. Upflow supercritical reactors have a uniform increased residence time distribution (no channeling), but may experience difficulties due to undissolved portion of heavy fraction and large particles, such as carbon-containing compounds in the heavy fractions, accumulating in the bottom of the reactor. This accumulation may hinder the upgrading process and plug the reactor. Upflow reactors typically utilize catalysts to provide increased contact with the reactants; however, the catalysts may break down due to the harsh conditions of supercritical water, forming insoluble aggregates, which may generate coke. Horizontal reactors may be useful in applications that desire phase separation or that seek to reduce pressure drop, however; the control of hydrodynamics of internal fluid is difficult. Each type of reactor flow has positive and negative attributes that vary based on the applicable process; however, in some embodiments, an upflow or downflow reactor may be favored.

The combined feed streams 132, 232, and 332 may be introduced through an inlet port of the supercritical upgrading reactors 140, 240, and 340. The supercritical upgrading reactors 140, 240, and 340 may operate at a temperature greater than the critical temperature of water and a pressure greater than the critical pressure of water. In one or more embodiments, the supercritical upgrading reactors 140, 240, and 340 may have a temperature of between 380° C. to 480° C., or between 390° C. to 450° C. The supercritical upgrading reactors 140, 240, and 340 may be an isothermal or non-isothermal reactor. The reactor may be a tubular-type vertical reactor, a tubular-type horizontal reactor, a vessel-type reactor, a tank-type reactor having an internal mixing device, such as an agitator, or a combination of any of these reactors. Moreover, additional components, such as a stirring rod or agitation device may also be included in the supercritical upgrading reactors 140, 240, and 340.

The supercritical upgrading reactors 140, 240, and 340 may have dimensions defined by the equation L/D, where L is a length of the supercritical upgrading reactors 140, 240, and 340 and D is the diameter of the supercritical upgrading reactors 140, 240, and 340. In one or more embodiments, the L/D value of the supercritical upgrading reactors 140, 240, and 340 may be sufficient to achieve a superficial velocity of fluid greater than 0.5 meter (m)/minute (min), or an L/D value sufficient to achieve a superficial velocity of fluid between 1 m/min and 5 m/min. Such relatively high fluid velocity is desired to attain full turbulence of the internal fluid. The desired Reynolds number (a measurement of fluid flow) is greater than 5000. Reynolds number is given by the relationship:

$$\mathrm{Re} = \frac{uD}{v}$$

where u is the superficial velocity, D is the diameter of the supercritical upgrading reactor, and v is the kinematic viscosity. If that equation is rewritten as $$u = \frac{v\mathrm{Re}}{D}$$

it can be observed from this relationship that by decreasing the reactor diameter (D) the superficial velocity (u) is increased (because u and D are indirectly proportional to each other $$\left(u\alpha\frac{1}{D}\right)).$$

For a fixed reactor length at a reference case, decreasing the reactor diameter (D) will increase the ratio (L/D). Furthermore, by increasing the superficial velocity (u), Reynolds Number (Re) is increased (because u and Re are directly proportional to each other (uαRe). Therefore, from the above rationale, in order to maintain the flow in high flow turbulence regime (Re>5000), it is required to increase the superficial velocity, and/or decrease the reactor's diameter, and by decreasing the reactor's diameter, the ratio (L/D) is also increased.

In some embodiments, the residence time of the internal fluid in the supercritical upgrading reactors 140, 240, and 340 may be longer than 5 seconds, such as longer than 1 minute. In some embodiments, the residence time of the internal fluid in the supercritical upgrading reactor 140, 240, and 340 may individually be from 1 to 30 minutes, from 1 to 20 minutes, from 1 to 15 minutes, from 1 to 12 minutes, from 1 to 10 minutes, from 1 to 8 minutes, from 1 to 5 minutes, from 1 to 2 minutes, from 2 to 30 minutes, from 2 to 20 minutes, from 2 to 15 minutes, from 2 to 12 minutes, from 2 to 10 minutes, from 2 to 8 minutes, from 2 to 5 minutes, from 5 to 30 minutes, from 5 to 20 minutes, from 5 to 15 minutes, from 5 to 12 minutes, from 5 to 10 minutes, from 5 to 8 minutes, from 8 to 30 minutes, from 8 to 20 minutes, from 8 to 15 minutes, from 8 to 12 minutes, from 8 to 10 minutes, from 10 to 30 minutes, from 10 to 20 minutes, from 10 to 15 minutes, from 10 to 12 minutes, from 12 to 30 minutes, from 12 to 20 minutes, from 12 to 15 minutes, from 15 to 30 minutes, from 15 to 20 minutes, or from 20 to 30 minutes. In embodiments, the residence time may be no greater than 15 minutes.

At this point in the process, the process shown in FIG. 2 begins to mirror the process shown in FIG. 1. Therefore, upon exiting the supercritical blending vessel 150, the upgraded blended hydrocarbon-based composition 151 may have a temperature of from 380° C. to 450° C., from 380° C. to 425° C., from 380° C. to 400° C., from 400° C. to 450° C., from 400° C. to 425° C., or from 425° C. to 450° C. at the critical pressure of water. In embodiments, the blended hydrocarbon-based composition 151 may then be cooled by cooler 154 to a temperature of from 180° C. to 250° C., from 180° C. to 225° C., from 180° C. to 200° C., from 200° C. to 250° C., from 200° C. to 225° C., or from 225° C. to 250° C. at the critical pressure of water to form a cooled, upgraded blended hydrocarbon-based composition 153. The upgraded blended hydrocarbon-based composition 151 is similar to the blended hydrocarbon-based composition 152, and differ in that they are formed from different process configurations. In particular, the blended hydrocarbon-based composition 152 exits the blending vessel 150 after each individual component stream was upgraded in separate supercritical water reactors at a shorter residence time, whereas the upgraded blended hydrocarbon-based composition 151 exits the blending vessel 150 after each individual component stream was upgraded and blended in the supercritical blending vessel 150 at a relatively longer residence time.

Upon exiting the cooler 154, the pressure of the cooled, upgraded blended hydrocarbon-based composition 153 may be reduced to create a depressurized, upgraded blended hydrocarbon-based composition 155, which may have a pressure from 0.01 to 1.0 MPa, from 0.01 to 0.8 MPa, from 0.01 to 0.5 MPa, from 0.01 to 0.3 MPa, from 0.01 to 0.1 MPa, from 0.01 to 0.08 MPa, from 0.01 to 0.05 MPa, from 0.01 to 0.03 MPa, from 0.03 to 1.0 MPa, from 0.03 to 0.8 MPa, from 0.03 to 0.5 MPa, from 0.03 to 0.3 MPa, from 0.03 to 0.1 MPa, from 0.03 to 0.08 MPa, from 0.03 to 0.05 MPa, from 0.05 to 1.0 MPa, from 0.05 to 0.8 MPa, from 0.05 to 0.5 MPa, from 0.05 to 0.3 MPa, from 0.05 to 0.1 MPa, from 0.05 to 0.08 MPa, from 0.08 to 1.0 MPa, from 0.08 to 0.8 MPa, from 0.08 to 0.5 MPa, from 0.08 to 0.3 MPa, from 0.08 to 0.1 MPa, from 0.1 to 1.0 MPa, from 0.1 to 0.8 MPa, from 0.1 to 0.5 MPa, from 0.1 to 0.3 MPa, from 0.3 to 1.0 MPa, from 0.3 to 0.8 MPa, from 0.3 to 0.5 MPa, from 0.5 to 1.0 MPa, from 0.5 to 0.8 MPa, or from 0.8 to 1.0 MPa. The depressurizing can be achieved by many devices, for example, a valve 158 as shown in FIGS. 1 and 2.

The depressurized, upgraded blended hydrocarbon-based composition 155 may then be passed to a gas/oil/water separator 160. The gas/oil/water separator 160 may separate the depressurized, upgraded blended hydrocarbon-based composition 155 into a second gas fraction 174, a second liquid oil fraction 172, and a second water fraction 176. The gas/oil/water separator 160 may be any separator known in the industry. While the gas/oil/water separator 160 may separate the depressurized, upgraded blended hydrocarbon-based composition 155 into at least a second gas fraction 174, a second liquid oil fraction 172, and a second water fraction 176, it should be appreciated that additional fractions may also be produced. The second gas fraction 174 may include CO, $CO_2$, $H_2S$, $C_1$, $C_2$, $C_3$, $C_4$, or combinations thereof. The second liquid oil fraction 172 may have a $T_5$ TBP of from 100° C. to 350° C., from 100° C. to 325° C., from 100° C. to 300° C., from 100° C. to 250° C., from 100° C. to 200° C., from 200° C. to 350° C., from 200° C. to 325° C., from 200° C. to 300° C., from 200° C. to 250° C., from 250° C. to 350° C., from 250° C. to 325° C., from 250° C. to 300° C., from 300° C. to 350° C., from 300° C. to 325° C., or from 325° C. to 350° C. The second liquid oil fraction 172 may have a $T_{90}$ TBP of from 200° C. to 450° C., from 200° C. to 425° C., from 200° C. to 400° C., from 200° C. to 375° C., from 200° C. to 350° C., from 200° C. to 300° C., from 300° C. to 450° C., from 300° C. to 425° C., from 300° C. to 400° C., from 300° C. to 375° C., from 300° C. to 350° C., from 350° C. to 450° C., from 350° C. to 425° C., from 350° C. to 400° C., from 350° C. to 375° C., from 375° C. to 450° C., from 375° C. to 425° C., from 375° C. to 400° C., from 400° C. to 450° C., from 400° C. to 425° C., or from 425° C. to 450° C. In embodiments, the second liquid oil fraction 172 may have an API gravity of from 35° to 50°, from 35° to 45°, from 35° to 42°, from 35° to 40°, from 35° to 37°, from 37° to 50°, from 37° to 45°, from 37° to 42°, from 37° to 40°, from 40° to 50°, from 40° to 45°, from 40° to 42°, from 42° to 50°, from 42° to 45°, or from 45° to 50°. The second gas fraction 174 may be passed to a gas storage tank 165, the second liquid oil fraction 172 may be passed to an oil storage tank 163, and the second water fraction 176 may be passed to a water storage tank 167.

EXAMPLES

It should be apparent to those skilled in the art that various modifications and variations may be made to the embodiments described within without departing from the spirit and scope of the claimed subject matter. Thus, it is intended that the specification cover the modifications and variations of the various embodiments described within provided such modifications and variations come within the scope of the appended claims and their equivalents.

As used throughout the disclosure, the singular forms "a," "an" and "the" include plural referents unless the context clearly dictates otherwise. Thus, for example, reference to "a" component includes aspects having two or more such components, unless the context clearly indicates otherwise.

Having described the subject matter of the present disclosure in detail and by reference to specific embodiments thereof, it is noted that the various details disclosed within should not be taken to imply that these details relate to elements that are essential components of the various embodiments described within, even in cases where a particular element is illustrated in each of the drawings that accompany the present description. Further, it should be apparent that modifications and variations are possible without departing from the scope of the present disclosure, including, but not limited to, embodiments defined in the appended claims. More specifically, although some aspects of the present disclosure are identified as particularly advantageous, it is contemplated that the present disclosure is not necessarily limited to these aspects.

What is claimed is:

1. A process for blending a hydrocarbon-based composition comprising:

combining a first heated water stream with a first pressurized, heated hydrocarbon-based composition comprising asphaltene in a mixing device to create a first combined feed stream;

allowing the first heated water stream and the first pressurized, heated hydrocarbon-based composition to interact such that the first combined feed stream comprises micelles and reverse micelles, thereby preventing asphaltene aggregation;

combining a second heated water stream with a second pressurized, heated hydrocarbon-based composition comprising asphaltene in a mixing device to create a second combined feed stream;

allowing the second heated water stream and the second pressurized, heated hydrocarbon-based composition to interact such that the second combined feed stream comprises micelles and reverse micelles, thereby preventing asphaltene aggregation;

introducing the first combined feed stream and the second combined feed stream into a supercritical blending vessel operating at a temperature greater than a critical temperature of water and a pressure greater than a critical pressure of water; and blending the first combined feed stream and the second combined feed stream to form a blended hydrocarbon-based composition.

2. The process of claim 1, wherein the first heated water stream is saturated, the second heated water stream is saturated, or both.

3. The process of claim 1, wherein the first and second heated water streams have a temperature from 100° C. to 370° C.

4. The process of claim 1, wherein the first and second pressurized, heated hydrocarbon-based compositions have a temperature from 100° C. to 370° C.

5. The process of claim 1, wherein the supercritical blending vessel has a temperature of greater than 375° C. and less than 600° C. and a pressure greater than 22.1 MPa and less than 75 MPa.

6. The process of claim 1, wherein the supercritical blending vessel comprises a static mixer, an inline mixer, an impeller, or combinations thereof.

7. The process of claim 1, wherein the asphaltene in the first pressurized, heated hydrocarbon-based composition exists in a form of aggregated asphaltene molecules, and wherein allowing the first heated water stream and the first pressurized, heated hydrocarbon-based composition to interact to form the first combined feed stream improves the stability of the first combined feed stream due to polar-polar interaction between water molecules and aggregated asphaltene molecules.

8. The process of claim 7, wherein blending the first combined feed stream and the second combined feed stream breaks the aggregated asphaltene molecules into smaller asphaltene molecules, wherein the smaller asphaltene molecules have a particle size less than a particle size of the aggregated asphaltene molecules.

9. The process of claim 8, wherein the aggregated asphaltene molecules have a particle size of from 1 to 800 microns and the smaller asphaltene molecules have a particle size of from 0.1 nanometers to 300 nanometers.

10. The process of claim 1, further comprising passing the blended hydrocarbon-based composition to a gas/oil/water separator and separating the blended hydrocarbon-based composition in the gas/oil/water separator to produce a gas fraction, a liquid oil fraction, and a water fraction.

11. A process for blending a hydrocarbon-based composition comprising:

combining a first heated water stream with a first pressurized, heated hydrocarbon-based composition comprising asphaltene in a mixing device to create a first combined feed stream;

allowing the first heated water stream and the first pressurized, heated hydrocarbon-based composition to interact such that the first combined feed stream comprises micelles and reverse micelles, thereby preventing asphaltene aggregation;

introducing the first combined feed stream into a first supercritical upgrading reactor operating at a temperature greater than a critical temperature of water and a pressure greater than a critical pressure of water;

at least partially converting the first combined feed stream to a first upgraded product;

combining a second heated water stream with a second pressurized, heated hydrocarbon-based composition comprising asphaltene in a mixing device to create a second combined feed stream;

allowing the second heated water stream and the second pressurized, heated hydrocarbon-based composition to interact such that the second combined feed stream comprises micelles and reverse micelles, thereby preventing asphaltene aggregation;

introducing the second combined feed stream into a second supercritical upgrading reactor operating at a temperature greater than a critical temperature of water and a pressure greater than a critical pressure of water;

at least partially converting the second combined feed stream to a second upgraded product;

passing the first upgraded product out of the first supercritical upgrading reactor to a supercritical blending vessel operating at a temperature greater than a critical temperature of water and a pressure greater than a critical pressure of water;

passing the second upgraded product out of the second supercritical upgrading reactor to the supercritical blending vessel operating at a temperature greater than a critical temperature of water and a pressure greater than a critical pressure of water; and blending the first upgraded product and the second upgraded product to form an upgraded blended hydrocarbon-based composition.

12. The process of claim 11, wherein the first heated water stream is saturated, the second heated water stream is saturated, or both.

13. The process of claim 11, wherein the first and second heated water streams have a temperature from 100° C. to 370° C.

14. The process of claim 11, wherein the first and second pressurized, heated hydrocarbon-based compositions have a temperature from 100° C. to 370° C.

15. The process of claim 11, wherein the supercritical blending vessel has a temperature of greater than 375° C. and less than 600° C. and a pressure greater than 22.1 MPa and less than 75 MPa.

16. The process of claim 11, wherein the supercritical blending vessel comprises a static mixer, an inline mixer, an impeller, or combinations thereof.

17. The process of claim 11, wherein allowing the first heated water stream and the first pressurized, heated hydrocarbon-based composition to interact to form the first combined feed stream improves the stability of the first combined feed stream due to polar-polar interaction between water molecules and aggregated asphaltene molecules.

18. The process of claim 17, wherein blending the first upgraded product and the second upgraded product breaks the aggregated asphaltene molecules into smaller asphaltene molecules.

19. The process of claim 18, wherein the aggregated asphaltene molecules have a particle size of from 1 to 800 microns and the smaller asphaltene molecules have a particle size of from 0.1 nanometers to 300 nanometers.

20. The process of claim 11, further comprising passing the upgraded blended hydrocarbon-based composition to a gas/oil/water separator and separating the upgraded blended hydrocarbon-based composition in the gas/oil/water separator to produce a gas fraction, a liquid oil fraction, and a water fraction.

* * * * *